US006817671B1

(12) United States Patent
Zheng

(10) Patent No.: US 6,817,671 B1
(45) Date of Patent: Nov. 16, 2004

(54) COLLAPSIBLE RECLINING CHAIR

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 0 days.

(21) Appl. No.: 10/416,083

(22) PCT Filed: Nov. 6, 2000

(86) PCT No.: PCT/US00/41982

§ 371 (c)(1),
(2), (4) Date: Sep. 22, 2003

(87) PCT Pub. No.: WO02/38009

PCT Pub. Date: May 16, 2002

(51) Int. Cl.[7] ..... A47C 7/54

(52) U.S. Cl. ..... 297/411.39; 297/188.14; 297/45

(58) Field of Search ..... 297/45, 188.14, 297/411.39, 452.13, 423.26, 16.1, 16.2, 21, 22, 68; 29/428

(56) References Cited

U.S. PATENT DOCUMENTS 2,738,001 A * 3/1956 Drabert ..... 297/328
3,124,387 A * 3/1964 MacLaren ..... 297/16.2
4,715,650 A * 12/1987 Berman et al. ..... 297/28
4,968,095 A * 11/1990 Moyer ..... 297/411.39
5,058,950 A * 10/1991 Mann ..... 297/45
5,498,054 A * 3/1996 Tomlinson ..... 297/16.2
6,082,820 A * 7/2000 Jeng ..... 297/326
6,149,238 A * 11/2000 Tsai ..... 297/411.43
6,264,271 B1 * 7/2001 Munn et al. ..... 297/45
6,601,912 B1 * 8/2003 Chen ..... 297/45

* cited by examiner

*Primary Examiner*—Milton Nelson, Jr.
(74) *Attorney, Agent, or Firm*—Rutan & Tucker

(57) ABSTRACT

A collapsible chair has a seat (102), rear leg (110), and an armrest (160), and further has a back support element (120) and a pair of lateral cross braces (130, 140). The back support element is pivotally coupled to the rear leg, and the lower end of the back support element is movably guided along one first cross brace by a guiding element (150), while the armrest is coupled to the upper end of the other cross brace. Preferred collapsible chairs include a footrest (180) that moves upward and forward, when the backrest reclines. A locking mechanism (170) provides for reclining of the back support among a continuous set of positions.

20 Claims, 3 Drawing Sheets

COLLAPSIBLE RECLINING CHAIR

FIELD OF THE INVENTION

The field of the invention is collapsible furniture.

BACKGROUND OF THE INVENTION

Folding chairs have been known for many years, if not centuries. The distinguishing feature of this invention is that the chair can be manipulated between a closed position in which the back is pivoted to approximate the seat, and an open position in which the back is disposed more or less perpendicular to the seat.

More recently collapsible chairs have gained widespread attention. Collapsible chairs are different from folding chairs in that the legs can be manipulated to approximate each other in close parallel or substantially parallel relationship. Thus, the legs come together in both a front to back direction as well as a side-to-side motion. The back may optionally fold against the seat, but the action is not necessarily included in collapsible chairs. U.S. Pat. No. 3,124,387 to Maclaren (March 1964) depicts an early collapsible chair in which the seat and back are formed from a continuous piece of fabric. These are so-called sling type chairs. There have been many other designs over the years, including hinged lawn chairs such as that described in U.S. Pat. No. 4,715,650 to Berman et al. (December 1987), and U.S. Pat. No. 5,058,950 to Mann (October 1991).

Approximating the legs, seat frame, and back is a relatively complicated business, primarily because the seat is more or less perpendicular to both the legs and back. Reclining the backrest relative to the seat add yet additional complexity, and may not be known to exist in any fashion in collapsible chairs. In this respect it must be observed that the term "reclining" is used herein to mean that the backrest can vary at least 10 degrees among a plurality of significantly different angles of inclination while the chair is in a sitting configuration.

Thus, there is a continuing need to provide novel methods and apparatus for collapsible chairs having a reclining backrest

SUMMARY OF THE INVENTION

The present invention provides methods and apparatus in which a collapsible chair has a back that reclines relative to the seat by at least 10 degrees while the chair is in a sitting configuration. The reclining motion is preferably substantially continuous, rather than being limited to being locked in four or five preset positions.

Various objects, features, aspects, and advantages of the present invention will become more apparent from the following detailed description of preferred embodiments of the invention, along with the accompanying drawings in which like numerals represent like components.

DETAILED DESCRIPTION

A chair according to the inventive subject matter generally has a seat supported at least indirectly and at least in part by a front leg and a back leg, wherein the chair is collapsible in both front to back direction and side-to-side direction. The chair further has, a back support attached to the back support element, which is mechanically coupled to the back leg such that a movement of the back support element is associated with reclining of the backrest.

Figure 1:
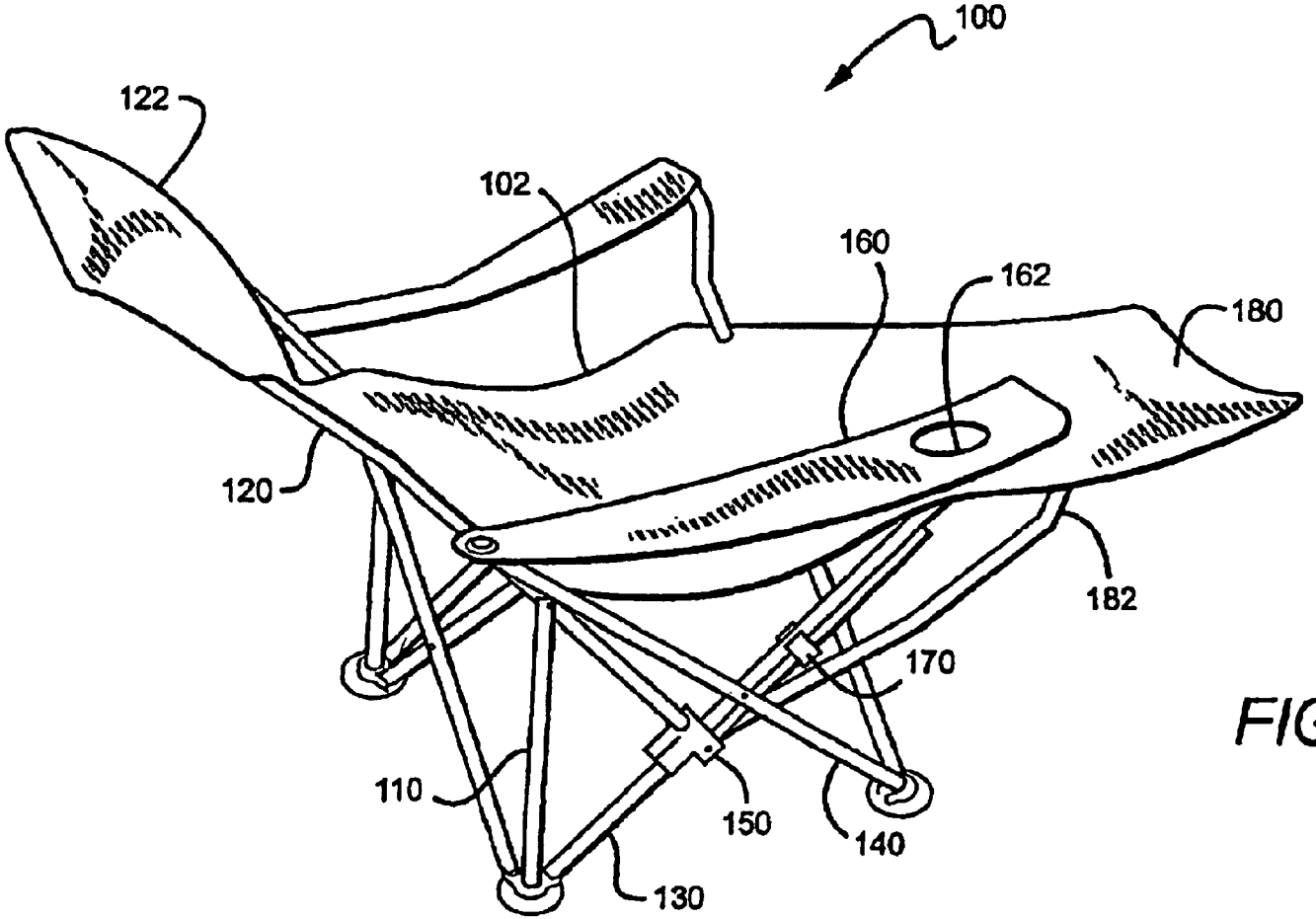
FIG. 1 is a perspective view of a collapsible reclining chair in a reclined position according to the inventive subject matter.
Figure 2:
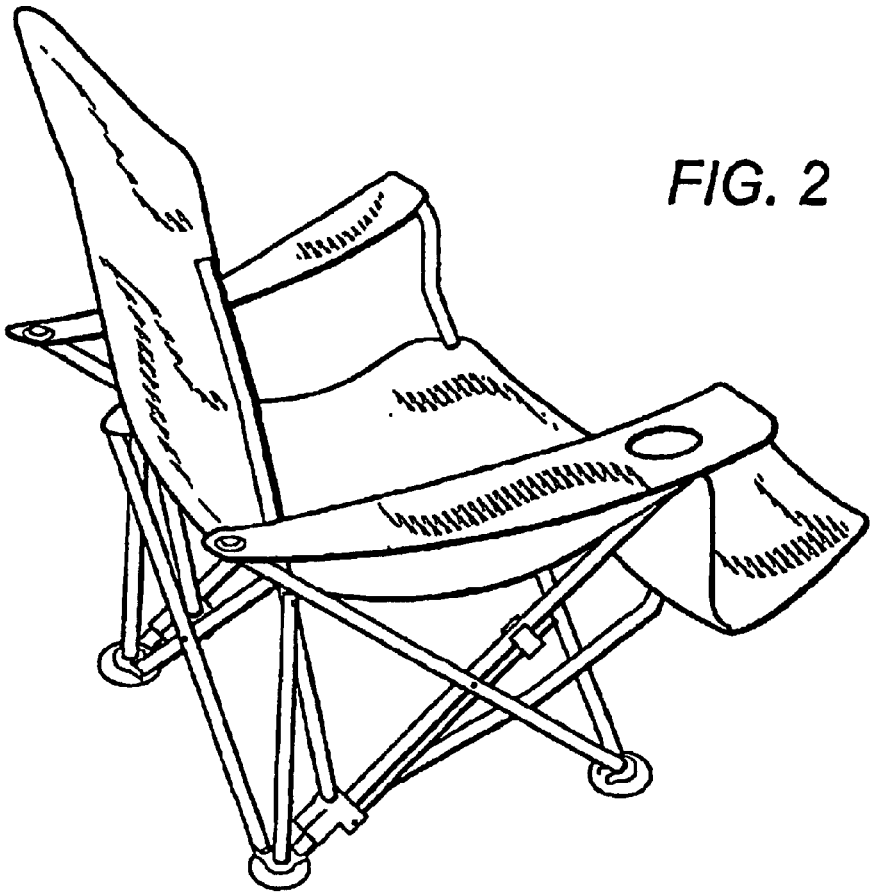
FIG. 2 is a perspective view of the collapsible reclining chair of FIG. 1 in an upright position.

More particularly, contemplated collapsible reclining chairs include a seat, a rear leg, an armrest, a back support element having a lower end, and a first lateral cross brace and a second lateral cross brace, wherein each of the cross braces have an upper end and a lower end. The back support element is pivotally coupled to the rear leg, wherein the lower end of the back support element is movably guided along the first cross brace by a guiding element, and wherein the armrest is coupled to the upper end of the second lateral cross brace. It is generally contemplated that reclining chairs according to the inventive subject matter collapse in a single movement In one aspect of the inventive subject matter as depicted in FIG. 1, a collapsible chair 100 with a seat 102 has a rear leg 110 and a back support element 120 rotatably attached thereto. A back support 122 is coupled to the back support element 120. The chair further comprises first and second lateral cross braces 130 and 140, respectively, wherein the back support element 120 is movably guided along the first lateral cross brace 130 by the guiding element 150, and wherein the armrest 160 (with optional opening 162) is coupled to the second lateral cross brace 140. A locking member 170 cooperates with the first lateral cross brace 130 to provide for locking the back support element 120 among a continuous set of positions. A movable footrest 180 is further coupled to the guiding element 150 via footrest support bar 182. FIG. 2 depicts the same collapsible reclining chair in an upright position.

In one aspect of the inventive subject matter, the seat is fabricated from a woven synthetic polymer (e.g., polyacetate) and is uniformly colored (e.g., blue). Particularly preferred seats have a width of about 21 inches when measured between the front legs, and a width of about 18 inches when measured between the back legs. The overall length of preferred seats is about 24 inches. However, it should be recognized that many materials, colors, and sizes are also appropriate. For example, alternative materials may include natural and synthetic materials and all reasonable combinations thereof. Contemplated materials may further be woven or non-woven, and particularly contemplated materials include polyester, nylon, polyvinyl chloride, cotton, hemp, and wool. With respect to the color, it is contemplated that suitable colors need not be restricted to uniform color, but appropriate colors may also include color patterns, prints, or no color at all.

While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative seats may have dimensions that are wider than 18–21 inches, and suitable widths include 21–24, 24–30, and 3040 inches, and wider, but also 16–18, 12–16, and 8–12 inches and narrower. Likewise, the length of appropriate seats may vary between 20–42, 15–10, and 12–15 inches and less, but also between 24–27, 27–30, and more. While contemplated seats are generally tapered from the front end to the back end, alternative chairs may also have no taper or a taper inverse to generally contemplated seats.

With respect to the back support (i.e., backrest) and the movable footrest it is contemplated that the backrest and the movable footrest are fabricated from the same material as the seat, and that at least one of the backrest and the movable footrest is continuous with the seat. Thus, it is preferred that the backrest has a width of about 18 inches where the backrest is coupled to the seat, and a width of approximately 20 inches on top. A preferred height of the backrest is about 18 inches. Similarly, it is preferred that the movable footrest has a length of about 30 inches, and a width of about 21 inches where the footrest couples to the seat. It is also preferred that contemplated footrests are tapered from the seat towards the end of the footrest. Where contemplated chairs include a footrest, it is especially preferred that the footrest moves in an upward direction when the back support element reclines. Such movement can be achieved by coupling the footrest to a footrest support bar, which is rotatably coupled to the guiding element.

With respect to the material and color of the backrest and the movable footrest, it is contemplated that the same considerations for the seat apply. However, it is contemplated that the width and height of suitable backrests may vary, and that width and height will depend among other things on the persons size and the number of persons to be seated in the chair. Likewise, width and length of suitable footrests may vary. Thus, alternative backrests and foot rests may have a width between 18–12 inches and less, but also between 18–22 and more. Similarly, contemplated backrests may have a height between 12–18 inches and less, but also between 18–25 inches and more. Contemplated footrests may have a length between 20–30 inches and less, but also between 30–35 inches and more.

Figure 4:
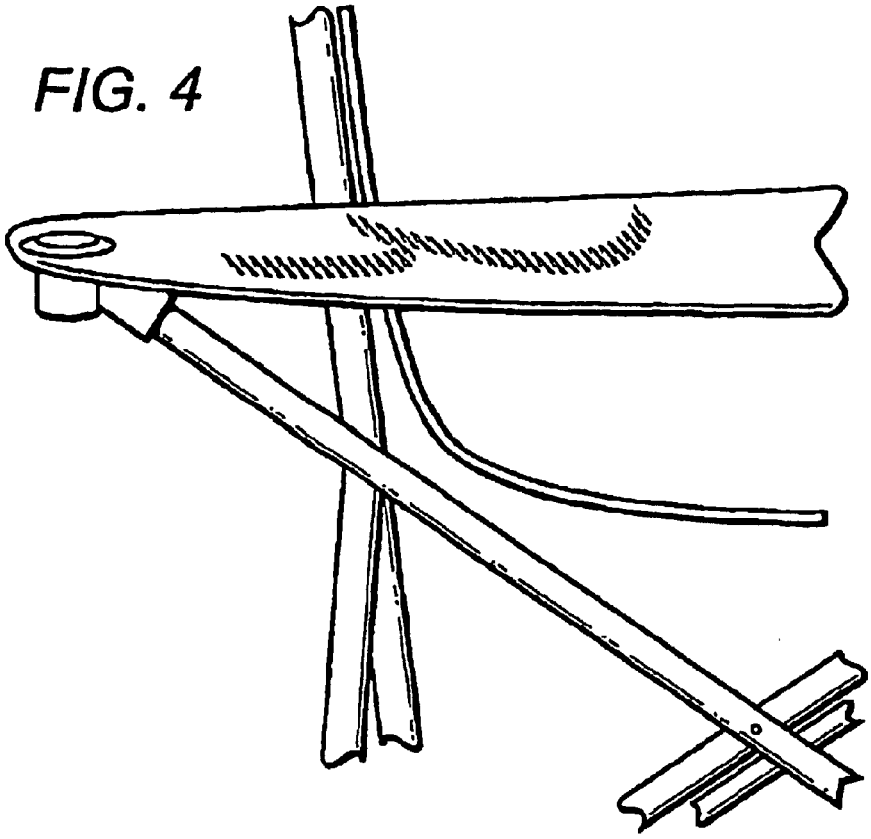
FIG. 4 is a perspective detail view of a rear section the armrest of the chair of FIG. 1.

In further alternative aspects, contemplated chairs may have at least one armrest which is coupled to the upper end of the second lateral cross brace. Suitable armrests may further include an opening and/or a pocket (e.g., to accommodate a soda can, a fishing pole, or both). It is generally preferred that the armrest(s) are manufactured from the same material and will have the same color scheme as the seat and/or backrest/footrest. However, it is also contemplated that suitable armrests may be fabricated from materials that are not the same as the seat and/or the backrest. It is further preferred that at least one of the arms is at least on one end removably coupled to the chair, and in a particularly preferred aspect, the arm rests are slidably engaged with the top portions of the second lateral cross brace and a frontal cross brace, respectively. It should be particularly appreciated that by virtue of the coupling of the armrest to the top end of the second lateral cross brace (ie., to a point independent of the reclining back support element), the armrest will substantially remain in the same attitude when the back support reclines. The term "substantially the same attitude" means that the angle between the armrest and the ground will change no more than 10 degrees, preferably no more than 5 degrees, and most preferably no more than 3 degrees. An exemplary coupling of the armrest to the top end of the second lateral cross bar is depicted in FIG. 4.

It is generally contemplated that the seat, the backrest and the armrests may be coupled to the legs, lateral cross braces, and other weight bearing elements in the collapsible chair in numerous ways, including temporary and permanent coupling. Temporary couplings include hook-and-loop type fasteners, snaps, buckles, slidable elements (e.g., a pouch slidably coupled to a post, a ring slidably coupled to a element, etc.), and threadably securable elements (e.g., laces threaded through rings). Permanent couplings include sewed or glued elements. For example, the backrest may be permanently coupled to the collapsible reclining chair via a crossbar sewed into the backrest. On the other hand, the front end of the seat may be temporarily coupled to the front legs via ring-shaped openings slided over the top ends of the front legs.

It should further be appreciated that the coupling of the seat, the backrest, and/or the armrest may be directly or indirectly coupled. As used herein, the term "direct coupling" means that the seat, the backrest, and/or the armrest re in immediate contact with the supporting structure (e.g., a leg, whereas the term "indirect coupling" means that an additional element connects the seat, the backrest, and/or the armrest with the supporting structure. For example, the seat may be directly coupled to the front legs via a slidable pouch. Alternatively, the seat may be indirectly coupled to the front legs via a ring-shaped opening in the seat that slidably engages with a leg.

With respect to the rear leg and the first and second lateral cross braces of contemplated chairs, it should be appreciated that the legs may be manufactured from various materials, including metals, metal alloys, natural and synthetic polymers, and any reasonable combination thereof. However, it is preferred that the legs are manufactured from black anodized aluminum tubing with a wall strength of about 1/32 inch and an outer diameter of approximately ½ inch. Preferred alternative materials include stainless steel, fiberglass, and wood.

While the exact configuration of contemplated back support element is not limited to the inventive concept presented herein, preferred back support elements are straight aluminum elements that are directly coupled (e.g., slidably coupled into a corresponding pouch) to the left and right sides of the backrest (when the chair is in its operating configuration) and extend at least 10 inches towards the ground away from the backrest. Alternatively, the back support elements may be indirectly coupled to and/or separate from the backrest. For example, the backrest may have a separate support structure, and the back support elements may be mechanically coupled to the support structure. In other alternative configurations, the back support elements may further include elastic or otherwise flexible elements that may promote (e.g., via a spring) or inhibit (e.g., via a gas shock) reclining movement of the backrest. It should further be recognized that the material and configuration of suitable back support elements may vary considerably, and it is contemplated that appropriate materials include those as described for the legs (supra).

While it is generally preferred that contemplated chairs have two back support elements that are independently coupled to their respective guiding elements, one, or more than two back support elements are also contemplated, which may or may not be independently coupled to their respective guide elements.

Figure 3:
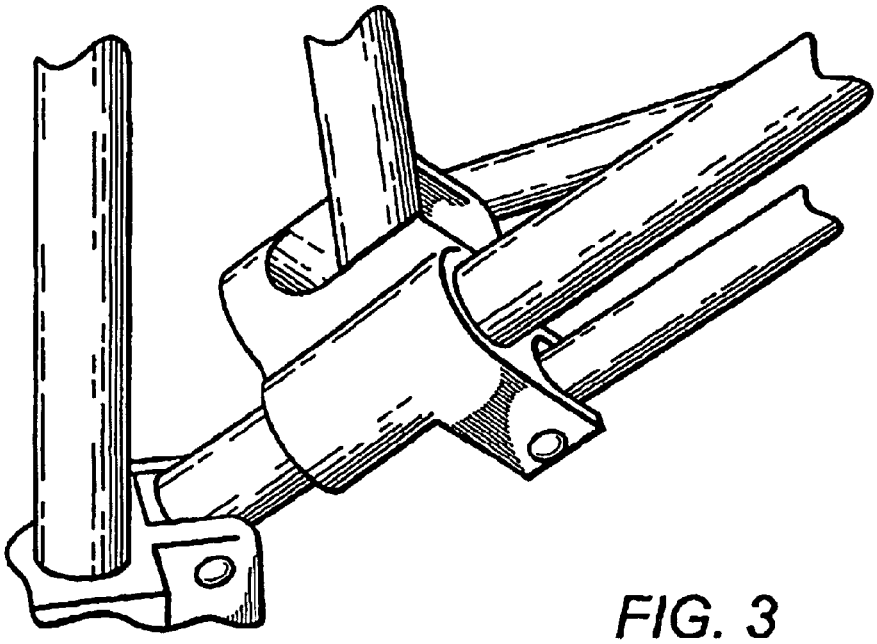
FIG. 3 is a perspective detail view of the guiding element of the chair of FIG. 1.

With respect to the guiding element it is preferred that contemplated chairs include a pair of guiding elements fabricated from a synthetic polymer (e.g., polyethylene or polystyrene), wherein each of the guiding elements is coupled to at least the first lateral cross brace and the back support element. It is generally contemplated that the guiding element is movably (and preferably slidably) coupled to the back support element and the first lateral cross brace, and that the guiding element is also rotatably coupled to the back support element. An exemplary guiding element is shown in FIG. 3. However, it should be recognized that the guiding element may also be a combination of two or more mechanically coupled elements, so long as alternative guiding elements movably (and preferably slidably) engage with the back support element and with the first lateral cross brace, and further rotatably engage with the back support element.

It is especially contemplated that where the coupling between the back support element and the first lateral cross brace is not self-locking (e.g., a ratchet-type lock), contemplated chairs may further comprise a locking mechanism that constrains the movement (i.e., allows locking) of the back support element relative to the first lateral cross brace. Particularly preferred locking mechanisms include a finger operable compression that engages with the first lateral cross brace and a support structure (e.g., a rod), which is mechanically coupled to the guiding element. Alternative locking members may also include a crank, and it is especially contemplated that the crank will cooperate with a corresponding rail in the first lateral cross brace or the back support element. It should further be appreciated that suitable locking members may also include elements that allow locking in predefined positions as well as elements (e.g., a slide) that allow locking among a continuous set of positions. Viewed from another perspective, the locking member and the guiding member cooperate to provide locking of the frame member at a substantial continuously variable set of positions. While it is generally contemplated that the locking mechanism may be attached to any portion of the chair, it is particularly preferred that the locking mechanism cooperates with a locking bar that is distinct from the back support element, which may be coupled to any portion of the chair.

Figure 5:
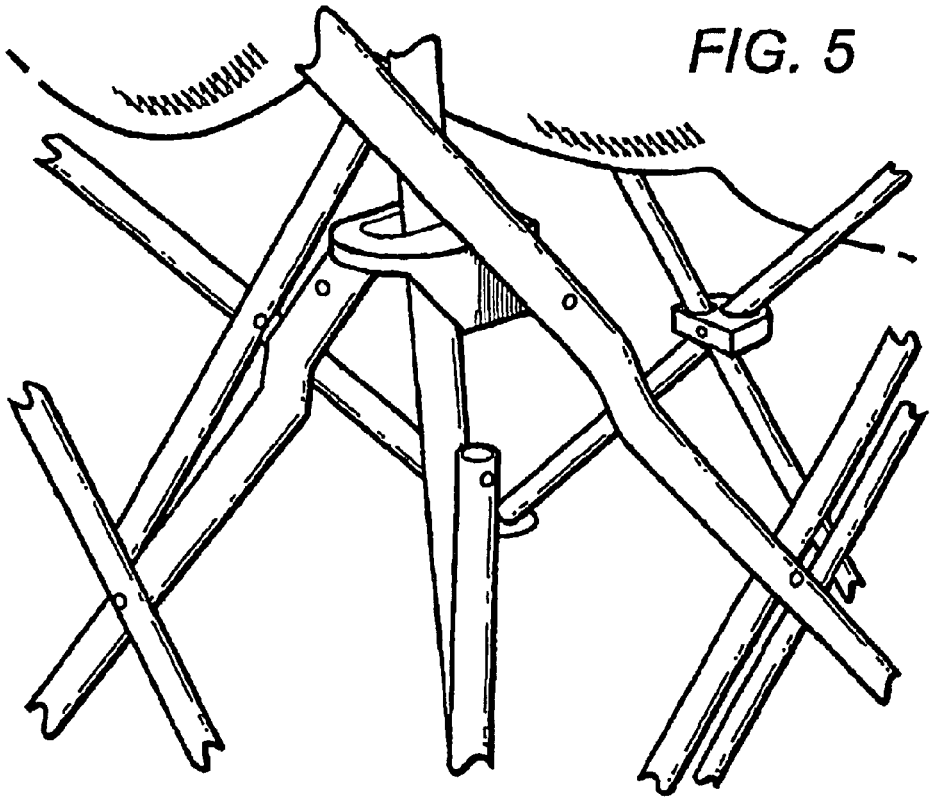
FIG. 5 is a perspective detail view of the pivotal coupling between the rear leg and the back support element of the chair of FIG. 1.

In still further aspects of the inventive subject matter, one or more support members may be coupled to at least one of the back support element, the guiding member, the rear leg, and the lateral cross braces. For example, a pair of rear cross bars may be coupled to the back support element via a slidable coupling element (as depicted in FIG. 5), and a pair of frontal cross bars may be coupled to an armrest. In still further contemplated aspects, connector elements may couple the bottom end of the rear leg, the bottom end of the first lateral cross brace and a bottom end of a rear cross bar, or the bottom end of second lateral cross bar and a bottom end of a frontal cross bar.

It should further be appreciated that the legs, frame member, and guiding member in contemplated chairs are coupled in a manner to allow front-to-back collapsibility and side-to-side collapsibility, preferably through pivots and pivotable joints. The term "front-to-back collapsibility" of a chair as used herein means that the front and the back portion of the chair can be approximated without disassembly of the chair. Likewise, the term "side-to-side collapsibility" of a chair as used herein means that both side portions of the chair can be approximated without disassembly of the chair.

In another preferred aspect of the inventive subject matter, a method of reclining a collapsible chair having a seat, a back support element, and a back support coupled to the back support element has one step in which a back support element is mechanically coupled to a rear leg such that a movement of the back support element is associated with reclining of the back support. In another step, a guiding element and a locking member are provided that cooperate with a lateral cross brace to provide locking of the back support element at a substantial continuously variable set of reclining positions. With respect to the seat the back support element, the back support, the rear leg, the guiding element, the locking member, and their interrelation all considerations as described above apply. Further contemplated methods include a step in which a movable footrest is coupled to the guiding element such that reclining of the back support results in an upward movement of the movable footrest.

Thus, specific methods and apparatus for collapsible reclining chairs have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A reclining chair comprising:

a seat, a rear leg, an armrest, a reclining back support element having a lower end, and a first lateral cross brace and a second lateral cross brace, each of the cross braces having an upper end and a lower end;

wherein the first and second lateral cross braces are pivotably coupled to the rear leg, and wherein the first and second lateral cross braces are pivotably coupled to each other;

wherein the back support element is pivotally coupled to the rear leg, and wherein the lower end of the back support element is movably guided along the first cross brace by a guiding element; and wherein one portion of the armrest is coupled to the upper end of the second lateral cross brace, wherein another portion of the armrest is coupled to the chair via a connector element, and wherein the armrest substantially remains in the same attitude when the back support element reclines, and;

wherein the reclining chair collapses in a single movement.

2. The reclining chair of claim 1 further comprising a movable footrest, wherein one portion of the footrest is coupled to the guiding element and another portion of the footrest is coupled to the seat.

3. The reclining chair of claim 2 wherein the movable footrest moves in an upward direction when the back support element reclines.

4. The reclining chair of claim 2 wherein the movable footrest is coupled to the guiding element by a footrest support bar.

5. The reclining chair of claim 2 wherein the movable footrest is continuous with the seat.

6. The reclining chair of claim 5 further comprising a back support coupled to the back support element, and wherein the back support is continuous with the seat.

7. The reclining chair of claim 1 wherein the armrest comprises at least one of an opening and a pocket.

8. The reclining chair of claim 1 wherein a back support is coupled to the back support element.

9. The reclining chair of claim 8 wherein the back support is continuous with the seat.

10. The reclining chair of claim 1 further comprising a locking member.

11. The reclining chair of claim 10 wherein the locking member locks a movement of the first lateral cross brace relative to the lower end of the back support element.

12. The reclining chair of claim 11 wherein at least one of the lower end of the back support element and the first lateral cross brace are coupled to a crank.

13. The reclining chair of claim 10 wherein the locking member provides for locking the back support element among a continuous set of positions.

14. A method of reclining a collapsible chair having a seat, a back support element, an armrest, and a back support coupled to the back support element, comprising:

mechanically coupling the back support element to a leg such that a movement of the back support element is associated with reclining of the back support;

providing a guiding element and a locking member that cooperate with a lateral cross brace to provide locking of the back support element at a substantially continuously variable set of reclining positions wherein the lateral cross brace is pivotably coupled to the rear leg;

coupling one portion of the armrest to the lateral cross brace and another portion of the armrest to the chair via a connector element; and wherein the armrest substantially remains in the same attitude when the back support reclines.

15. The method of claim 14 further coupling a movable footrest to the guiding element, wherein one portion of the footrest is coupled to the guiding element and another portion of the footrest is coupled to the seat.

16. The method of claim 15 wherein the movable footrest is coupled to the guiding element such that reclining of the back support results in an upward movement of the movable footrest.

17. The method of claim 14 wherein the locking member comprises a finger operable compression lock.

18. The method of claim 14 wherein the guiding element engages slidably with the back support element and the lateral cross brace, and rotatably couples the back support element and the lateral cross brace.

19. A collapsible reclining chair having a seat coupled to a back support, and an armrest coupled on one portion to a lateral cross brace that is pivotably coupled to a rear leg, wherein the chair collapses in a single movement when the seat pivots towards the back support, and wherein the armrest substantially remains in the same attitude when the back support reclines.

20. The collapsible chair of claim 19, wherein the seat is contiguous with the back support.

* * * * *